United States Patent [19]

Jancosek et al.

[11] Patent Number: 4,845,332

[45] Date of Patent: Jul. 4, 1989

[54] GALVANNEAL INDUCTION FURNACE TEMPERATURE CONTROL SYSTEM

[75] Inventors: David G. Jancosek, Valparaiso; Michael Demorotski, Portage; Gregory Noelting, Valparaiso, all of Ind.

[73] Assignee: National Steel Corp., Pittsburgh, Pa.

[21] Appl. No.: 97,186

[22] Filed: Sep. 16, 1987

[51] Int. Cl.[4] ..... H05B 6/06

[52] U.S. Cl. ..... 219/10.77; 219/10.71; 219/10.41; 219/10.61 R; 428/659; 427/45.1; 118/50.1; 118/620

[58] Field of Search ..... 219/10.77, 10.75, 10.43, 219/10.71, 10.69, 10.61 R, 10.57, 10.41; 428/659; 427/45.1, 46, 372.2, 374.2; 118/50.1, 620, 641, 642, 643

[56] References Cited

U.S. PATENT DOCUMENTS

| | | | |
|---|---|---|---|
| 2,448,008 | 8/1948 | Baker | 219/10.77 X |
| 2,986,808 | 6/1961 | Schnedler | 428/659 X |
| 2,992,311 | 7/1961 | Keller | 219/10.43 X |
| 3,056,694 | 10/1962 | Mehler et al. | 428/659 X |
| 3,190,768 | 6/1965 | Wright | 428/659 X |
| 3,740,859 | 6/1973 | Patton et al. | 219/10.77 X |
| 3,814,827 | 6/1974 | Stut | 219/10.43 X |
| 4,307,276 | 12/1981 | Kurata et al. | 219/10.77 X |
| 4,357,512 | 11/1982 | Nishimoto et al. | 219/10.77 X |

*Primary Examiner*—Philip H. Leung

*Attorney, Agent, or Firm*—O'Neil and Bean

[57] ABSTRACT

An induction galvanneal strip furnace utilizes a plurality of radiation (infrared or optical) pyrometers which measure strip temperature and provide a feedback signal which is compared with a set point or reference temperature signal from a set point generator to produce an error signal proportional to the measured variable minus the set point or reference temperature. The error signal is processed by use of a conventional proportions integrator derivative algorithm to produce a control signal which controls the electrical energy supplied to the induction coils. Each of the radiation pyrometers is positioned at the emergence or downstream side of the downstream most induction coil of a set of induction coils that it controls to thereby provide rapid, accurate control of strip temperature and with a more efficient utilization of electrical energy and high quality in the finished product. As compared to gas fired furnaces, the speed of the strip through the furnace of this invention can be increased 25 to 30 percent.

10 Claims, 5 Drawing Sheets

FIG. 2
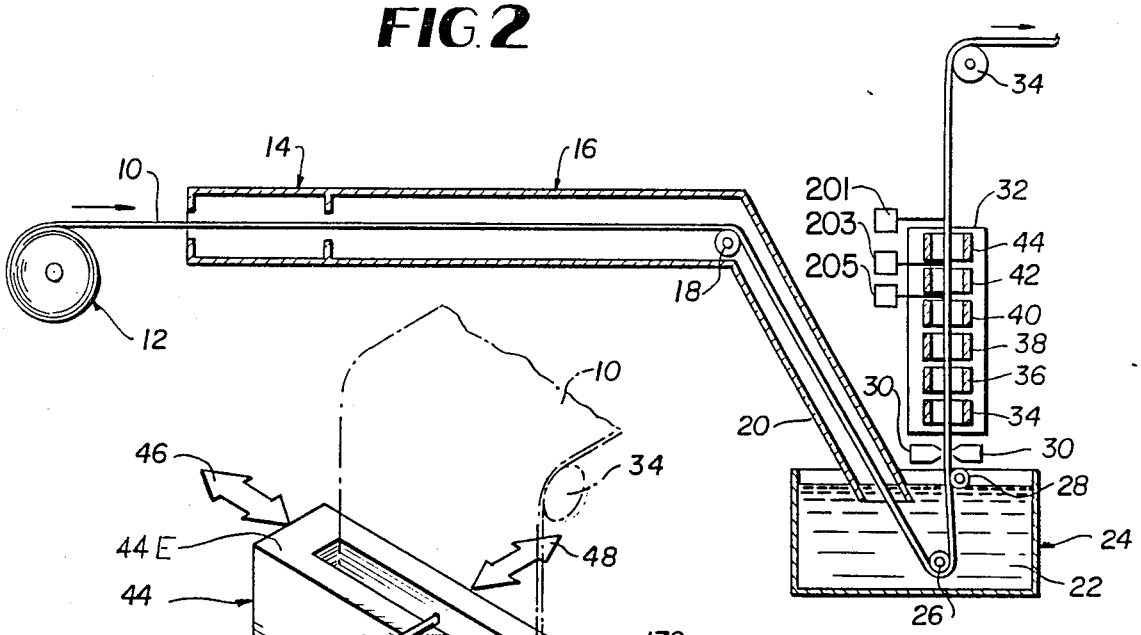
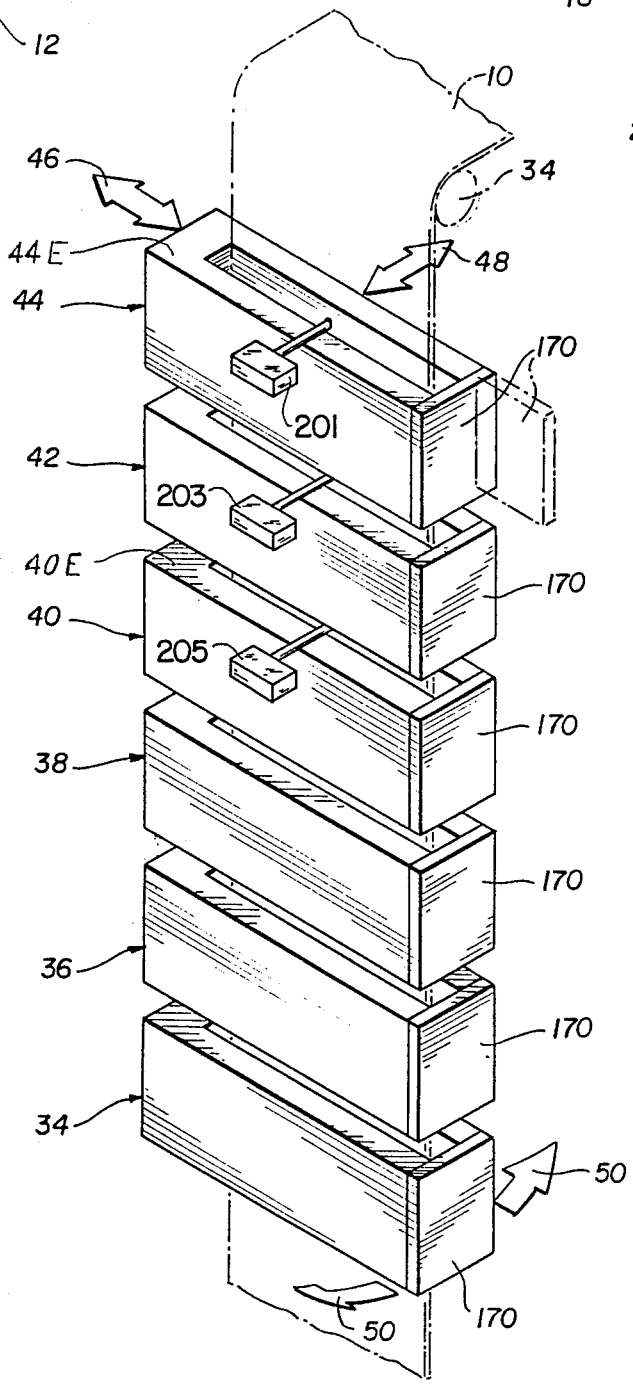
FIG. 3

10
201
44
203
42
40E
40
205
38
60
62
36
34
30
24
44E
32
66
68
64
58
60
71
54
62

GALVANNEAL INDUCTION FURNACE TEMPERATURE CONTROL SYSTEM

REFERENCE TO RELATED APPLICATIONS

This application is related to Ronald W. Scherer application Ser. No. 033,755 for "Electric Induction Heat Treating Furnace" filed Apr. 3, 1987 now abandoned.

BACKGROUND OF THE INVENTION

This invention relates to a temperature control apparatus and method for producing an alloy coating on a running length of metal in a heat treating furnace, and more particularly to an improved apparatus producing a zinc iron alloy coating on a running length of steel strip by initially coating the strip with a layer of zinc or zinc containing a small amount of aluminum as in a hot dipped galvanizing operation and subsequently converting the coating to a zinc iron alloy in an electric induction heat treating furnace in which the temperature of the strip is controlled by sensing the radiation emissivity of the strip as it leaves various sections of the induction heat heating furnace.

DESCRIPTION OF THE PRIOR ART

In the production of coated steel products in which a steel substrate is coated with a zinc iron alloy it is known to initially apply the coating as a substantially iron free zinc coating and to alloy the zinc with iron from the underlying substrate by heating the coated substrate to a temperature and for a time to permit iron molecules from the steel to be absorbed into and migrate through the zinc to produce the desired alloy coating.

Heat necessary to alloy a zinc coating on a continuous ferrous substrate such as steel strip, sheet, or wire (hereinafter strip) is conventionally applied by passing the zinc coated strip in a running length through a furnace similar to that employed in a continuous annealing operation. Such furnaces have an elongated heating chamber through which the strip passes and in which heat is applied in a controlled manner to quickly raise the temperature to the desired level and to maintain this temperature for the desired length of time. Conversion of an essentially pure zinc coating, or a coating containing small amounts of aluminum, to a zinc-iron alloy coating in this manner is known in the industry as a galvanneal process, and the product produced thereby is referred to as galvanneal product. The term galvanneal will therefore sometimes be used herein to refer generally to this basic process and product.

Prior art patents disclosing apparatus and process for the production of galvanneal in continuous strip form include U.S. Pat. Nos. 2,986,808 to Schnedler, 3,056,694 to Mehler et al and 3,190,768 to Wright (incorporated herein by reference). Each of these prior patents discloses the coating of a running length of steel strip in a conventional hot dip galvanizing operation and passing the coated strip into the galvanneal furnace immediately after exiting the molten zinc bath while the zinc coating is still in the molten or partially molten state. In the galvanneal furnace, heat is applied to increase the temperature of the steel strip and coating to a level and for a period of time to permit the alloying to be accomplished. A similar process is described in "Making, Shaping and Treating of Steel", 8th Ed., pg. 987.

While each of the above-mentioned patents suggests the use of electric energy and induction heating in the galvanneal furnace to heat the strip and coating to produce the desired alloying, none of these systems has been commercially successful and in commercial practice, galvanneal strip has universally been produced by use of a gas fired furnace, despite well recognized difficulties associated with the use of such gas fired furnaces. As pointed out in the Schnedler patent, one difficulty in using a gas fired furnace for the production of galvanneal is that the heat is externally applied and must be absorbed through the highly reflective zinc surface into the steel substrate for the alloying action to take place. Further as the alloying iron molecules migrate to the zinc surface, this surface becomes less reflective whereby substantially more heat is absorbed in those areas where alloying has been affected and alloying is accelerated while in areas where alloying has not progressed to the surface, surface reflectivity continues to retard alloying. According to the Schneider patent, this phenomenon can result in non-uniformity which may be multiplied nine fold in the final product.

Minor variations in thickness of the zinc coating applied to a steel strip as well as variations in the steel substrate itself, including surface conditions and strip thickness, also affect heat absorption in gas fired furnaces, resulting in further aggravation of the non-uniform alloying rate described above. Further the large banks of gas fired burners employed in such furnaces inherently produce large volumes of high temperature gas which, combined with air drawn by convection into the bottom of the furnace, passes upward with the moving strip in its path through the furnace. This chimney effect greatly inhibits the desired rapid cooling of the strip after leaving the furnace.

The inertia of gas fired furnaces has made it impossible to rapidly change the heat applied to a strip with the result that, once an unacceptable condition is detected, substantial waste product is frequently produced before it is possible to make the necessary adjustments to the furnace. Control of such furnaces is conventionally by a skilled operator positioned in a pulpit located to enable visual observance of the strip exiting the top of the furnace. If the strip has a surface which appears to be too reflective indicating insufficient alloying, the operator adjusted the furnace to provide more gas fuel and thereby increase temperature in the furnace; conversely, if the appearance indicates to the operator that excessive alloying has taken place, i.e., excessive iron in the zinc coating, temperature in the furnace is reduced. Variations in strip appearance, or reflectivity, combined with the intense flames in the furnace and the large volume of gas exiting the top of the furnace have made automatic sensing of strip temperature essentially impractical.

SUMMARY OF THE INVENTION

It is a primary object of the present invention to provide an improved temperature controlled induction furnace for use in the production of zinc iron alloy coated steel strip on a continuous basis.

A further object is to provide such an improved furnace including strip radiation emissivity measuring units for controlling the electrical energy induction heating coils for applying energy completely around a running length of zinc coated steel strip passing through the furnace in a more efficient and economical manner with a resulting high quality galvanneal product.

A further object is to provide such a furnace including means to accurately position the coils and the strip radiation emissivity measuring units relative to a running length of zinc coated steel strip passing therethrough to enable more efficient use of the electric energy while avoiding danger of contact between the running length of coated steel and the coils and the radiation emissivity measuring unit.

In the attainment of the foregoing and other objects, advantages and features of the invention, an important feature resides in providing a radiation emissivity sensor immediately at the downstream side (relative to strip movement) of at least one induction heating coil consisting of a plurality of loops of electrical conducting material through which a running length of zinc coated steel is passed during heat treatment in the furnace. The coil is designed to extend in closely spaced relation to the opposed side surfaces of a running length of coated steel strip during operation, with the coil extending around the edges of the strip to form the complete loop.

According to the present invention, an induction galvanneal strip furnace utilizes a plurality of radiation (infrared or optical) pyrometers or sensors which measure instantaneous strip temperature by its radiation emissivity characteristics and provide a temperature signal which is compared with a set point or reference temperature signal from a set point generator to produce an error signal proportional to the measured variable (instantaneous strip temperature) minus the set point or reference temperature. The error signal is processed by means of conventional proportions/integrator/derivative algorithm to produce a control signal which controls the electrical energy supplied to a set of the induction coils. The key or substantial variable is emissivity consistency. The emissivity of the strip stays constant in the induction process, since it is possible to measure strip temperature where the coating is always "wet", or molten. This is done by locating the pyrometer heads between the heating induction coils. Thus, the strip temperature can be measured in an absolute fashion. A given pyrometer is selected automatically by the computer to provide any combination of heating coils to insure emissivity consistency.

Each of the radiation pyrometers is positioned at the emergence or downstream side of the most downstream induction coil of a set of induction coils to thereby provide rapid, accurate (and flexible) control of strip temperature with much more efficient utilization of electrical energy and produce high quality in the finished product. As compared to current commercial gas fired furnaces of equivalent size, the speed of the strip through the furnace of this invention can be increased up to 25 to 30 percent.

In a preferred embodiment of the invention, the induction coil sets have movable conductor segments as disclosed in the above referenced Scherer application Ser. No. 033,755. The induction coil sets are mounted on a carriage or frame for movement on tracks to and away from the continuous strip. In this preferred embodiment, the radiation emission sensors are mounted on the coil frame in the spacing between, contiguous to, and immediately downstream of the last induction coil of each set of coils.

In a preferred embodiment, each coil is provided with movable connector door means at one end, in the manner disclosed and claimed in the above noted Scherer application Ser. No. 033,755 which is incorporated herein by reference.

The furnace includes a main frame supported by wheels on a pair of tracks extending in a horizontal direction and generally parallel to the side surfaces of a strip moving in the line, and a second or coil support frame is mounted on the main frame. The radiation emissivity measuring sensors (sometimes referred to as optical pyrometers) and the induction coils are mounted in the coil support frame to provide a substantially straight path through the open center of the coils. The second frame is mounted for limited movement in a horizontal direction perpendicular to the direction of movement of the main frame to thereby accurately position the coils relative to a strip passing through the furnace, and means is provided for adjusting the vertical alignment of the coil support frame whereby the position of the strip relative to the coils can be maintained constant throughout the length of the furnace to accommodate limited deviations in the strip path such as might be occasioned by use of an anti-flutter roll to deflect the strip for reducing flutter and transverse bowing of the strip during movement to the furnace.

The galvanneal process involves the reheating of the coated strip immediately after it leaves the zinc coating pot and the coating thickness control system such that the alloying of the zinc and iron will continue for a sufficient length of time for iron to diffuse into and throughout the zinc to the surface of the coating.

The coating will therefore be changed from substantially pure zinc to a uniform zinc-iron alloy which provides excellent characteristics for subsequent processing. The temperature at which the highest rate of alloying of zinc and iron occurs lies between 950 degrees Fahrenheit and 1050 degrees Fahrenheit and depends to a great extent on other process conditions. The use of induction heating ensures that temperatures in this range are easily produced and are controllable with great precision to suit the needs of the process.

An advantage of using an induction heater immediately after coating is that practically all of the heat is generated in the steel strip. The heat concentration at the nonferrous interface promotes better diffusion of the iron into the zinc.

By contrast, when conventional flame methods are used, the radiated heat must penetrate the unalloyed and highly reflective zinc coating. Accordingly, a greater time is required to develop the same degree of alloying between the two metals. This in turn means that the strip must occupy a greater length of time in the furnace. In the induction heating process, once the desired degree of zinc and iron alloying has occurred, the strip leaves the induction coil and immediately begins to cool. With a conventional gasheated system the chimney effect of the heated atmosphere above the furnace inhibits the rapid cooling of the strip.

The zinc-iron alloy coating contains normally about 13 percent iron. This gives the strip outer surface a dull grey appearance instead of the shiny aspect of conventional galvanized. It was found that galvanneal strip has better abrasion resistance characteristics than either the conventional galvanized strip or the more recently introduced electrolytic zinc coated strip. The iron-rich coating is paintable and weldable and is therefore being widely accepted in the automotive market.

INDUCTION HEATING OF STEEL STRIP

The fundamental concept of induction heating is quite simple. If an alternating current flows through a coil a magnetic field is produced and varies with the amount of current. The magnitude of the field will depend upon the amount of current and the number of turns in the coil. The field is concentrated inside the coil.

If a metal strip is placed inside the coil, eddy currents will be induced inside the strip. The eddy currents will flow in a direction opposite to the current flow in the coil. These induced currents also produce a magnetic field and since they are in the opposite direction of the field produced by the current in the coil, they prevent the field from penetrating to the center of the metal strip. The eddy currents are therefore, concentrated at the surface and decrease towards the center. This is often referred to as skin effect. The depth where the current density drops to a value of 37 percent of its surface value is called the penetration depth. All of the current under the curve can be thought of as being contained within this depth. This simplifying assumption is useful in calculating the resistance of the current path in the metal strip. Since the metal strip has resistance to the current flow, heat will be generated. The amount of heat generated is a function of the product of resistance and the current squared. The curve is much steeper and at the depth of penetration the heating effect will fall to approximately 13 percent of that at the surface.

The depth of penetration is an important factor in any induction heating operation, and is a function of three variables, two of which are related to the metal strip. The variables are the electrical resistivity of the strip, the relative permeability of strip and the frequency of the alternating current in the coil.

A determination of the depth of penetration will provide an indication of how much current will flow within the metal strip of a given thickness. If the strip is very thick, maximum current will flow; if the strip is very thin, compared to the depth of penetration, very little current will flow within the metal strip. Since the amount of heat generated is related to the current squared, it is important to have a high current flow in the metal strip. A rule of thumb often used is that for reasonable efficiency one should have a ratio of strip thickness to depth of penetration greater than three, and this ratio can be controlled by controlling the penetration depth. Since relative permeability is a function of power density and frequency, penetration depth can be controlled by selecting the proper frequency and power density, preferably such that for a given strip thickness, the ratio is greater than three.

The relative permeability for various power densities is also a function of temperature. The higher the temperature the less the relative permeability and therefore for a given strip thickness, the smaller the ratio and the less the heating.

The induction galvanneal furnace power level can be operated in a manual or in automatic mode from the operator's control keyboard. In the manual mode the computer outputs an analog signal, e.g., a 4–20 mA signal, selected by the operator, for any given Pacer in a manner similar to turning a rheostat on a control desk. In the automatic mode, the induction galvanneal furnace according to the present invention utilizes three (3) pyrometer heads which measure strip temperature, which strip temperature signal is provided as feedback for a PID controller to determine the output power for the induction furnace for a given set point.

BRIEF DESCRIPTION OF THE DRAWINGS

The foregoing features and advantages of the invention will be apparent from the following detailed description, taken in conjunction with the drawings, in which:

FIG. 2 is a schematic illustration of a continuous galvanneal line embodying the furnace of the present invention;

FIG. 3 is an isometric view schematically illustrating the path of a galvanized steel strip through a bank of induction coils in the galvanneal furnace according to the present invention;

DETAILED DESCRIPTION OF THE INVENTION

Figure 1A:
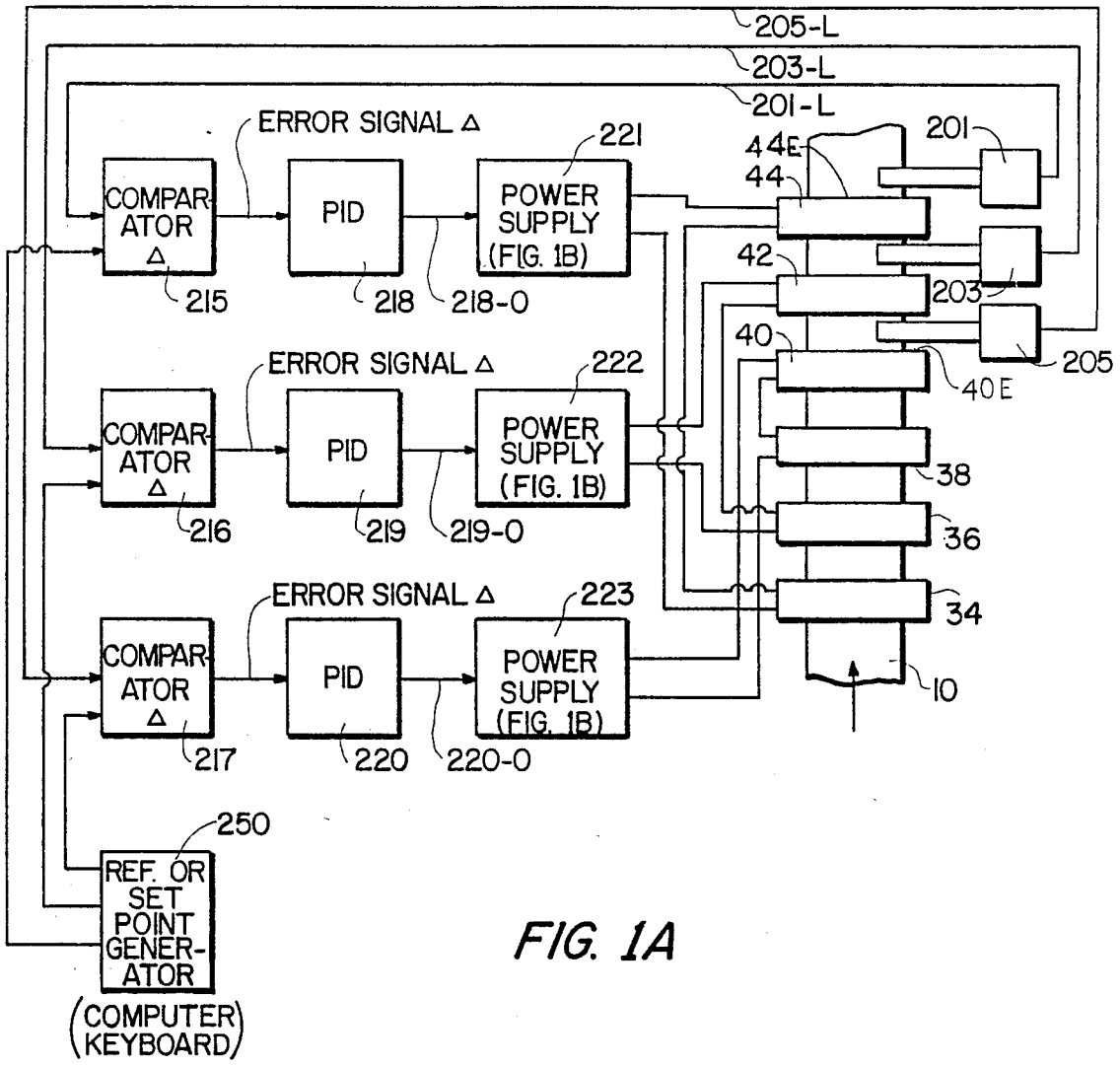
FIG. 1*a* is a schematic block diagram of the electrical supply system to the induction coils.

In FIG. 2, steel strip 10 is provided in continuous form from a suitable supply illustrated schematically by coil 12. The continuous strip passes through a suitable cleaning operation, not shown, and into a heating furnace 14 which, in practice, may be a multiple pass continuous annealing furnace or merely a heating chamber which brings the strip up to the desired temperature for galvanizing. From furnace 14, the strip is led through a non-oxidizing atmosphere in chamber 16, over a guide roll 18, and downwardly through snout 20 having its bottom open end disposed below the surface of a bath 22 of molten zinc contained in the spelter pot 24. Strip 10 passes around a sink roll 26 in the spelter pot, then upwardly and out of the bath in contact with an adjustable, partially submerged anti-flutter roll 28 and past a pair of adjustable air knives 30 which direct controlled streams of pressure gas onto the surface of the emerging coated strip to control the thickness and distribution of the layer of molten zinc adhering to the surface of strip 10. The process thus far described is a conventional hot dip galvanizing operation and further description thereof is not believed necessary for an understanding of the present invention, it being understood, of course, that other conventional galvanizing apparatus and practice may be employed in conjunction with the present invention.

From the coating control air knives 30, the zinc coated strip passes in a substantially straight path through a heat treating or galvanneal furnace 32 and upwardly around a guide roll 34, then proceeds to suitable coiling or other operations. Furnace 32 comprises a plurality of induction coils 34, 36, 38, 40, 42, 44, each providing, in operation, a closed electrically conductive circuit completely surrounding the coated strip in its path through the furnace whereby the strip passes through the open center of each induction coil as best seen in the schematic illustration of FIG. 3. Also, as illustrated in FIG. 3, and described more fully hereinbelow, the furnace 32 is supported for generally horizontal straight line movement in a direction parallel to the side surfaces of the strip 10 as illustrated by the arrow 46. Further, the induction coil assembly is supported in the furnace, for limited independent movement in a generally horizontal direction perpendicular to arrow 46 as indicated by the arrow 48 and for limited pivotal movement of the bottom end, i.e., the end at coil 34, in the direction of arrows 50 whereby vertical alignment of the coils may be adjusted to maintain the strip substantially centered through each coil despite deviations of the strip from the vertical in its movement through the furnace.

Radiation emissivity transducers or optical pyrometers 201, 202 and 203 are mounted on coil support frame assembly 78 at the positions shown in FIG. 1*a*.

Figure 4:
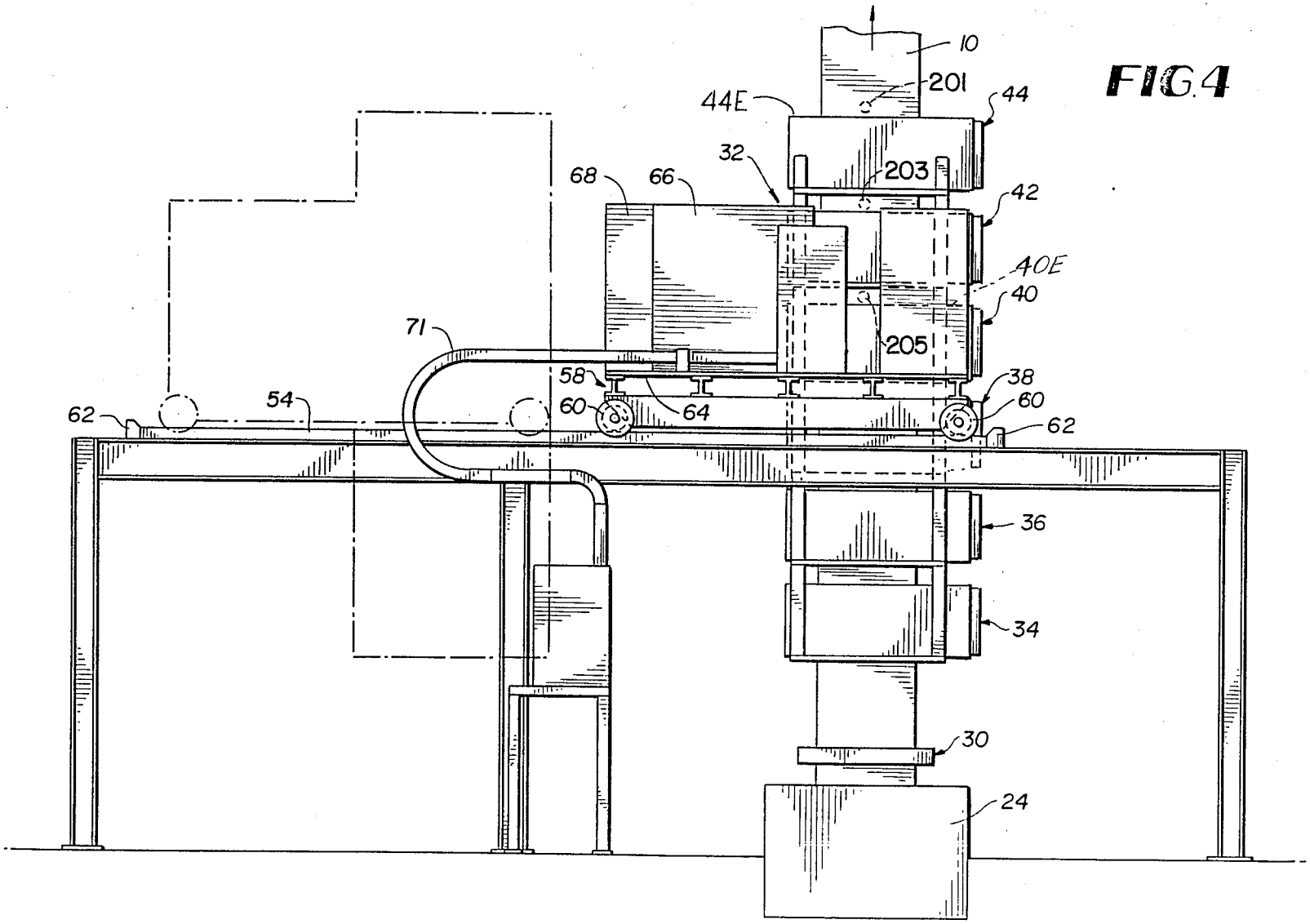
FIG. 4 is a side elevation view of a galvanneal furnace according to the present invention.
Figure 5:
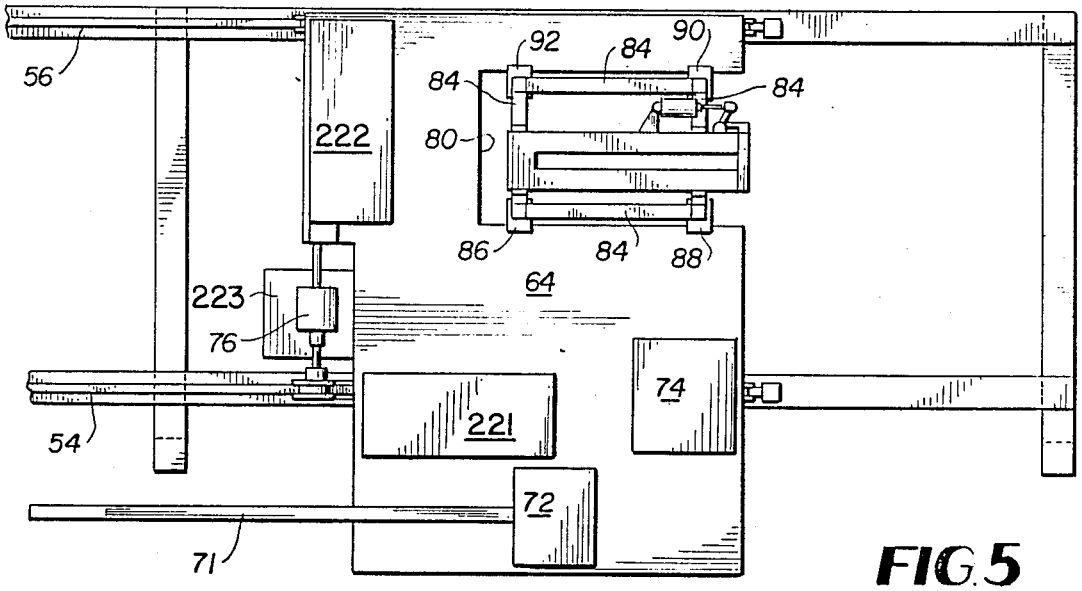
FIG. 5 is a top plan view of the structure shown in FIG. 4.
Figure 6:
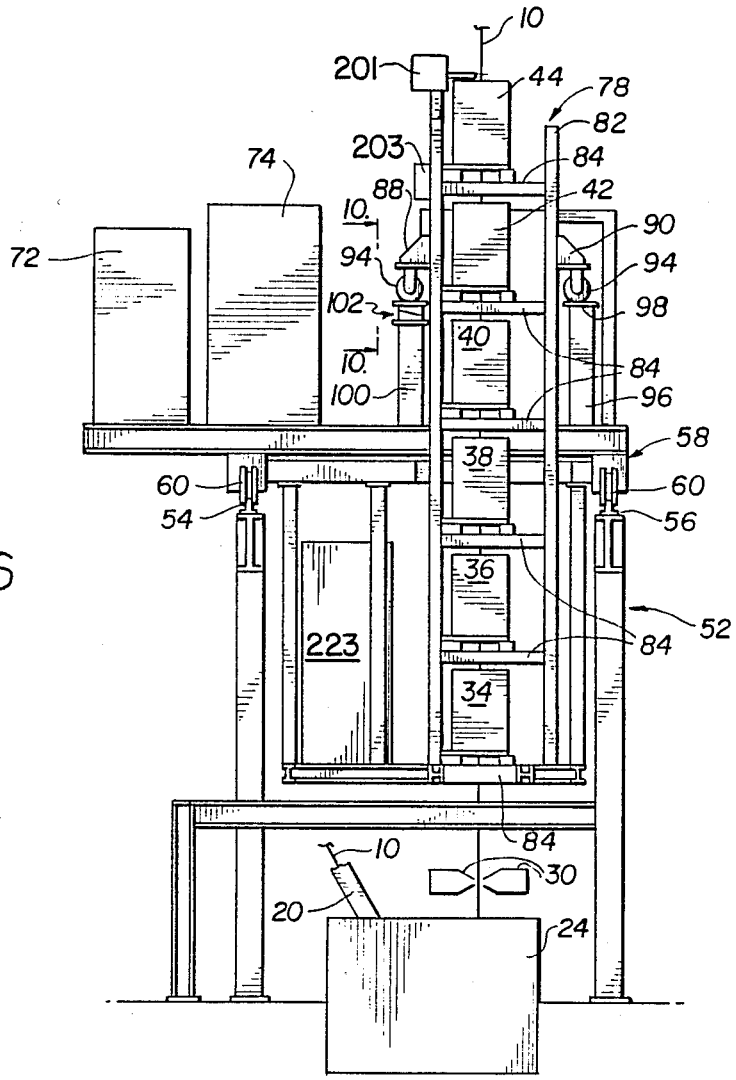
FIG. 6 is an end view of the structure shown in FIG. 4.

Referring now to FIGS. 4–6, it is seen that the furnace 32 is supported on a rigid stationary frame assembly 52 having a pair of laterally spaced, horizontal tracks 54, 56 extending above and laterally from the spelter pot 24. Furnace 32 includes a movable frame or carriage indicated generally at 58, supported by a plurality of wheels 60 engaging the tracks 54, 56. Stops 62 on the respective ends of tracks 54, 56, limit movement of the carriage 58 from a use position above the spelter pot 24 shown in full lines in FIG. 4 and a retracted or non-use position laterally spaced from the spelter pot 24 shown in broken lines in FIG. 4. Carriage 58 has a substantially horizontal, flat deck or platform surface 64. In the embodiment illustrated three power supply units 221, 222 and 223 are supported on carriage 58 for movement therewith, with each power supply providing current to two coils. A suitable flexible electrical supply cable and cooling water conduits are provided as illustrated at 71. A suitable pull box 72 for the electrical connections for the power supplies and the coils is also supported for movement with the platform as is a conventional heat station 74. Except for the control by optical pyrometers disclosed more fully hereafter, the power supplies, pull box and heat station are commercially available and are conventional in construction and form no part of the present invention. It is pointed out, however, that mounting this equipment for movement with the furnace greatly simplifies construction and protection of the electrical connections between the respective power supplies and the heating coils associated therewith. Suitable drive, such as a reversible motor acting through a reduction gear, indicated schematically at 76 in FIG. 5 is provided to drive the furnace 32 along tracks 54, 56.

A coil support frame assembly 78 is mounted on movable carriage 58 and provides support for the individual induction coil assemblies 34–44. Frame assembly 78 comprises an open, elongated generally rectangular frame structure extending in a generally vertical direction through a rectangular cut out 80 in platform 64 as best seen in FIG. 5. Frame assembly 78 is made up of four substanially identical elongated column members 82 disposed one at each corner of the rectangular frame assembly and connected by transverse structural members 84 to define an open truss-like frame for supporting the coils 34–44 in vertically spaced relation and in alignment with one another whereby the coated strip 10 may pass in a generally vertical path upwardly through the open center of the respective coils in the manner illustrated in FIGS. 2 and 3.

Four wheel brackets 86, 88, 90 and 92 are rigidly mounted on frame assembly 78 at a location spaced downwardly from the upper end thereof and each bracket mounts a grooved wheel 94 for rotation about horizontal axes parallel to tracks 54, 56. Wheels 94 supported on brackets 86, 88 are mounted for rotation about a common horizontal axis spaced outwardly from the columns 82 on one side of the strip while the wheels 94 on brackets 90, 92 are mounted for rotation about a second common horizontal axis spaced outwardly from the columns 82 on the other side of the frame 78.

A pair of rigid support posts 96, only one of which is seen in FIG. 6, are mounted on and extend upwardly from platform 64 and terminate at their top end in a horizontal bearing plate 98 disposed one beneath the wheels 94 on brackets 90 and 92. A similar, but slightly shorter pair of posts 100 mounted on platform 64 extend upwardly and support the wheels 94 on brackets 86, 88. Posts 100 each terminate at their top end in a height adjustment mechanism 102.

Figure 7:
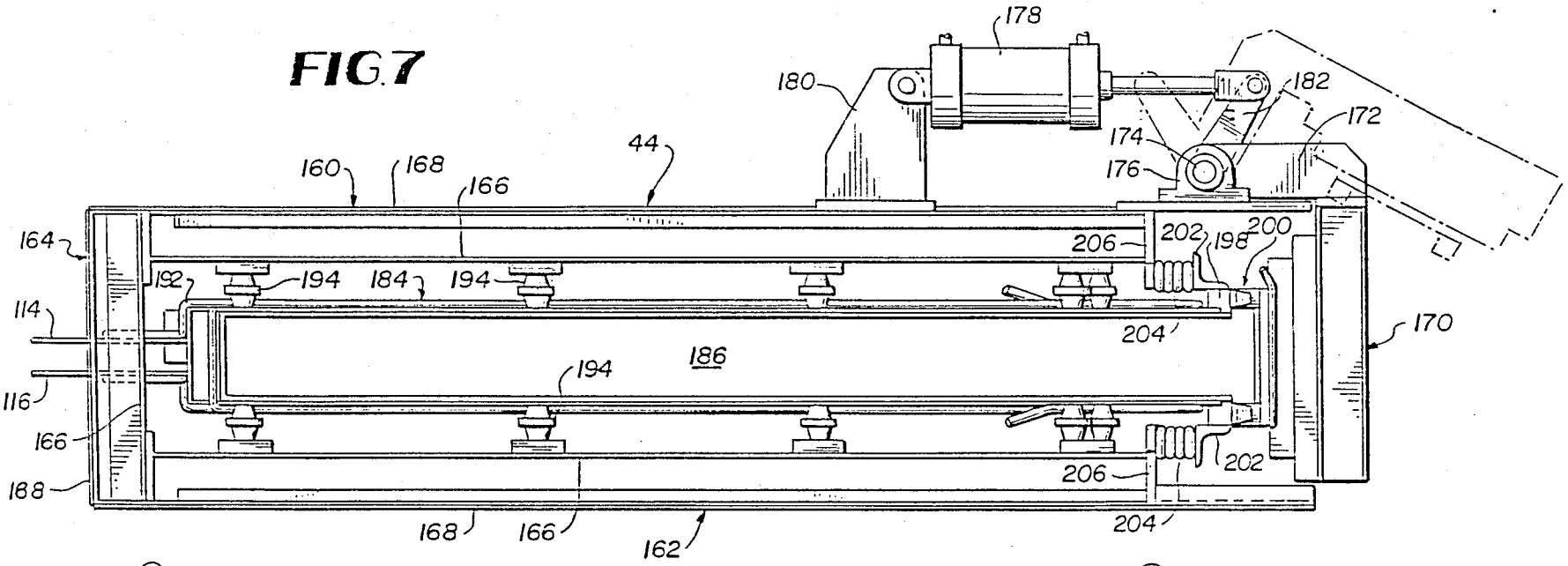
FIG. 7 is a plan view, on an enlarged scale, of one of the induction coil units employed in the furnace of the present invention.
Figure 8:
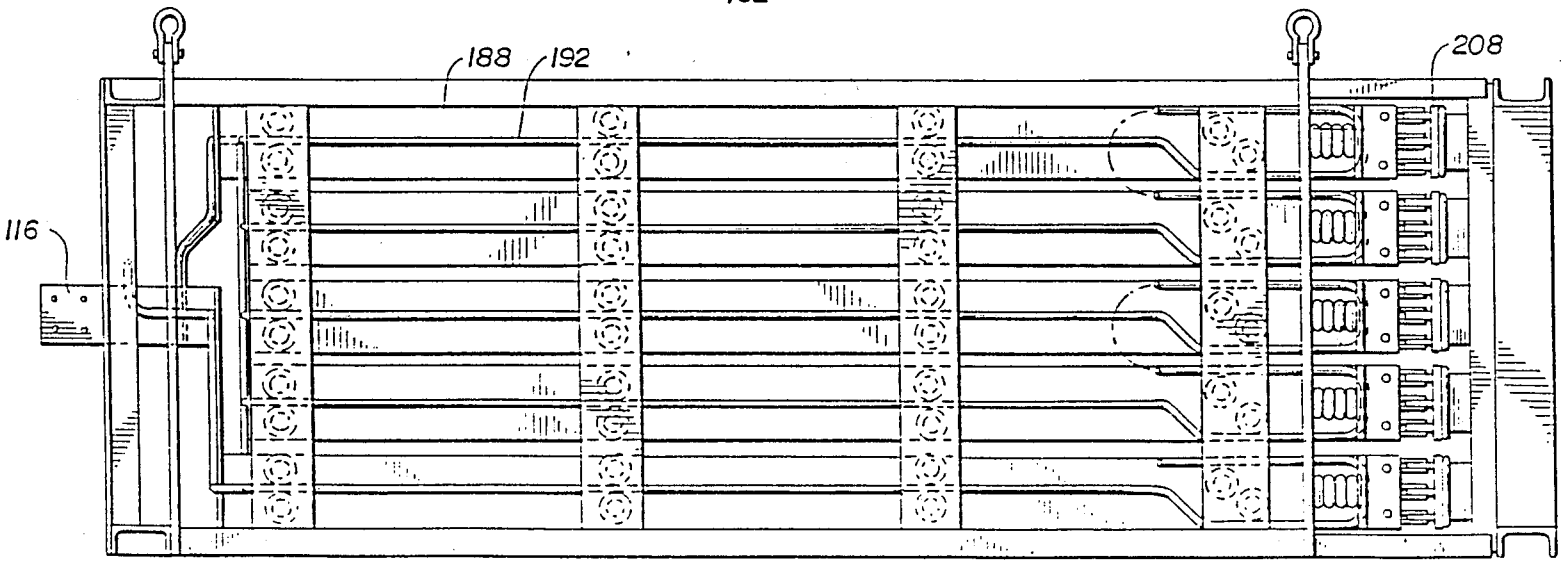
FIG. 8 is a side elevation view of the induction coil unit shown in FIG. 7.

Referring now particularly to FIGS. 7 and 8, the construction of the individual induction heating coils will be more fully described. Since coils 34–44 may be substantially identical in construction, only coil 44 will be described in detail, it being understood that the description applies equally to all coils used in a particular furnace construction. It should also be apparent that the number and size of the coils may vary depending on numerous factors including strip speed, product thickness, coating weight and the desired degree of alloying of the coating.

Coil assembly 44 includes an outer frame or housing having spaced sidewall assemblies 160, 162 joined at one end by a fixed end wall assembly 164. The sidewall and end wall assemblies are each made up of inner and outer, spaced panel members 166, 168, respectively. The end of the housing opposite wall 164 is closed during operation of the furnace by a movable connector door assembly 170 mounted, as by a rigid bracket 172, for pivotal movement about a shaft 174 supported by journal bearings 176 on wall 160. A double acting fluid cylinder 178 having its cylinder end pivotally connected on bracket 180 on sidewall 160 and its rod end pivotally connected to an actuating arm 182 is employed to move the door 170 between the closed and open positions shown in full line and in broken line, respectively, in FIG. 7.

An electrical inductance coil assembly 184 is supported within the housing and provides a plurality of loops of electrical conductor material extending completely around the path of the strip through the open center 186 of each coil when door 170 is closed. Conductor material in the coils may comprise a generally flat copper bar 188 having a layer of insulating material bonded to its inwardly directed surface and a heat exchanger tube 192 joined, as by brazing, directly to its outer surface. A plurality of electrically insulating connectors 194 extend between the individual conductor bars 188 and the internal wall 160 of the furnace housing to support the induction coil within the housing.

The conductor bars 188 extend in vertically aligned parallel relation to one another and in inwardly spaced relation to the sidewalls 160, 162 and terminate at the end adjacent the movable door 170 in a free end. Each free end has mounted thereon the resilient contact elements 198 of a triple contact knife connector assembly indicated generally at 200. To provide strength and dimensional stability to the switch contact elements 198, an angle member 202 is connected to each and is joined, through insulators 204 to a rigid bracket 206 in the housing.

A plurality of electrical conductor bars 208 are mounted on the inwardly directed surface of movable door 170, and knife elements of the triple knife connector 200 are mounted on the opposed ends of the conductor bars 208 in position to fit between and make electrical contact with the resilient contact elements 198 when the door 170 is in the closed position shown in full lines in FIGS. 7 and 8. In practice, the triple contact connector is designed so that contact by one knife member with a cooperating pair of resilient contact elements 198 will carry the necessary current for operation of the furnace, with the remaining two being provided for maximum assurance of proper contact. A heat exchanger tube extends along the back of each conductor bar 208 in the door assembly and cooling water is provided to the heat exchanger during operation to prevent overheating of the conductor bar. Similarly, cooling water is provided through the heat exchanger tube 192 to extract heat from the conductor bars 188. Tubes 192 on each conductor bar are connected by suitable conduits, not shown, to provide a continuous path for the cooling water along each conduit bar 188.

Electrical current is provided to the coil assembly from a suitable bus bar through connector plates 114, 116 and the conductor bars 188 on opposing sides of the elongated rectangular opening 186 are connected at the closed end of the coil, i.e., the end adjacent end wall 164, to provide a continuous current path from connector plate 114 to plate 116 through the respective conductor bars 188 in housing 160 and bars 208 on movable door 170 when the door is in the closed position.

When it is desired to remove the galvanneal furnace from the galvanizing line, it is only necessary to deenergize the coils and open all of the connector doors 170 by applying fluid pressure to the rod end of cylinder 178. Once the doors are open, drive motor 76 may be energized in the direction to drive wheels 60 along tracks 54, 56 to move the furnace to the non-use position shown in broken lines in FIG. 4. Conversely, to position the furnace on-line, it is only necessary to reverse the drive motor 76 to locate the furnace in the operable position with the strip passing upward through open centers 186 of the respective coils. The connector door assemblies may then be closed by applying fluid pressure to the cylinder end of cylinder 178.

Once the furnace is in position above the spelter pot 24, the coil support frame may be accurately positioned relative to the strip to initially position the vertical center plane of the coil assemblies parallel to the side surfaces of the strip passing therethrough by pivoting the frame 78 about the axis of the wheels 94 on brackets 90, 92. A worm screw actuator is then used to accurately center the strip within the openings 186. This accurate alignment and positioning of the furnace greatly enhances the efficiency of the furnace by enabling the coil assemblies to be constructed so that the conductors pass in closely spaced relation to the strip. Further, accurate positioning of the strip relative to the coils produces a substantially more uniform, high quality product not achievable with prior art furnaces known to applicant.

THE PRESENT INVENTION

In a preferred embodiment of the present invention, the coils 34, 36, 38, 40, 42, and 44 are arranged in substantially vertically aligned sets and in the disclosed preferred embodiment, there are two coils per set. Thus, with six coils, 34, 36, 38, 40, 42 and 44, for example, there will be three coil sets:

(1) the top coil 44 and the bottom coil 34 being electrically connected and the energy thereto from one of the three power supply units 221, 222 or 223 separately controlled by a radiation emissivity sensing transducer unit or radiation emissivity sensing transducer or optical pyrometer 201 mounted adjacent the downstream edge 44E of top coil 44 in position to sense the temperature of the strip as it emerges bearing the heating effect of all energized coils;

(2) the coil 42 second from the top and the coil 36 second from the bottom being electrically connected and the electrical energy thereto from another of the power supplies being controlled by a radiation emissivity sensing transducer unit 203 located to view the moving strip in the space between coils 42 and 44; and (3) the two center coils 38 and 40, which are electrically connected and supplied by the third power supply with electrical energy controlled by a third radiation emissivity sensing transducer or optical pyrometer 205 which is positioned or located in the space between the coil second from the top (coil 42) and the upper edge 40E of the coil 40 which is third from the top of the induction furnace.

The control loop for each radiation emissivity transducer (FIG. 1*a*) includes comparators 215, 216 and 217 to receive temperature signals (e.g. 4 mA to 20 mA corresponding to 900 to 1600 degrees Fahrenheit), radiation emissivity from pyrometers 201, 203 and 205 on lines 201-L, 203-L, and 205-L, respectively, and set point or reference temperature signals from set point or reference generator 250. The error signals (Δ) from these comparators 215, 216 and 217 are processed by a conventional proportional (gain) integral (reset) and derivative (rate) algorithm in microprocessor 218, 219 and 220, respectively, to produce control signals on outputs 218-0, 219-0 and 220-0, which in turn are supplied to the microprocessors 234 in the power system shown in FIG. 1*b*.

While the comparators and PID elements are shown as separate units, it will be appreciated that they are preferably a single integrated circuit element or microprocessor. A computer automatically selects the proper transducer 201, 203, 205 for any combination of heating coils to ensure emissivity consistency. A single microprocessor can be used to provide the reference or set point temperature signal, and the functions of each of the comparators and PID units. Moreover, such computer can scan each of the pyrometer inputs to provide full on-line control of each of the power units by using all or selected ones of the pyrometers and/or power units. While the control can easily be performed on an analog basis, digital control system is preferred.

Figure 1B:
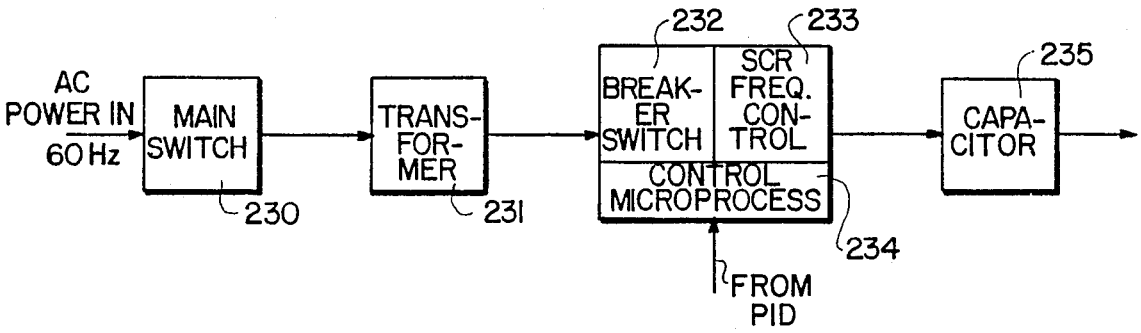
FIG. 1*b* is a block diagram of the main power system.

One of the power units 221, 222, 223 for one coil set is illustrated schematically in FIG. 1*b* and is conventional. It includes main switch 230 coupling ac power to transformer 231 which, in turn, supplies ac power to breaker switch 232 to an SCR frequency converter 233. A microprocessor 234 controls the SCR converter and the power supplied to the induction coil set via a bank of power factor correction capacitors 235. In a typical system, the temperature control signal supplied to the microprocessor ranges from about 4 mA for 0 to 20 mA for full or 100 percent power output. The feedback electrical signal from pyrometers 201, 202 and 203 represent the actual strip temperature, which after processing in the PID's shown in FIG. 1*a*, and supplied to microprocessor 234, ranges from about 4 mA for 0 power to about 20 mA for full or 100 percent power output. In the disclosed embodiment, the radiation pyrometers are IRCON infrared pyrometers having a range of about 900 degrees Fahrenheit to about 1600 degrees Fahrenheit.

Some advantages found in induction heating according to this invention include the following:

1. The ability to instantaneously generate a precise amount of heat results in increased "prime" production of 25 to 30% compared to conventional gas fired furnaces.

2. Energy consumption is related directly to the throughput of steel thus avoiding wasted energy.

3. Better cooling after alloying due to the absence of a "chimney effect" from heat generation normally accompanying a gas fired unit.

4. Heat generation at the steel-to-zinc interface accelerates diffusion and promotes uniform coating.

5. Approximately 50 percent additional heating capacity is accomplished within the same space limitations of conventional, commercial gas fired furnaces.

While a preferred embodiment of the invention has been disclosed and described in detail, it should be apparent that the invention is not so limited but rather that various modifications may be made to the structure, and it is intended to cover all embodiments of the invention which would be apparent to one skilled in the art and which come within the spirit and scope of the invention.

What is claimed is:

1. In an electric induction furnace for use in a continuous galvanneal operation wherein a zinc coating applied to the surface of a running length of steel is converted to a zinc iron alloy coating by passing the running length of zinc coated steel along a generally straight vertical path through the induction furnace and heating the coated strip during upward movement through the furnace to alloy the zinc coating with iron from the steel strip, said furnace having at least one induction coil including electric conductor means defining a closed loop having an opening through which the running length of coated steel passes in its upward movement through the furnace, a frame supporting said at least one induction coil, and power means supplying electric current to the conductor means for inductively heating the coated strip passing through the closed loop, the improvement comprising, radiation emissivity transducer means having a predetermined frequency range mounted on said frame with said induction coil and oriented to detect the radiation emission of said strip on the side of at least one said induction coil at a first location immediately downstream thereof where the coating is in the molten state, and producing a first electrical signal corresponding to the instantaneous temperature of said strip at that location, reference means for producing a second electrical signal corresponding to the desired temperature of said strip at said first location, means for comparing said first electrical signal with said second electrical signal and producing a furnace temperature control signal, control means for controlling the electrical energy to said induction coil, and means for applying said furnace temperature control signal to said control means to modify the electrical energy to said induction coil.

2. The electric induction furnace defined in claim 1 wherein said furnace comprises a plurality of sets of said induction coils, each set including an upper coil and a lower coil, means connecting said coils of a set in series circuit, and a plurality of said radiation emissivity transducer means, there being a radiation transducer means for each coil set and located adjacent the exit of the upper coil of each coil set.

3. The electric induction furnace defined in claim 2 wherein said radiation emissivity transducers are optical pyrometers.

4. The electric induction furnace defined in claim 1 wherein said induction coil and said radiation emissivity transducer means are mounted on a movable carriage, said coil having an end section which is movable to permit said coil to be opened and moved on said carriage from encirclement of said strip to an ineffective position.

5. An electric induction galvanneal furnace control system comprising, means for passing a continuous steel strip from a pot of molten coating metal in an upward direction through a substantially vertical path, a plurality of sets of induction heating coils positioned along said path, with said induction heating coils being electrically connected to a source of electrical energy, control means for individually controlling the energy to said coils comprising:

(a) a plurality of radiation sensors for sensing the radiation emissivity of the strip as a function of the temperature of said strips, each said radiation emission sensor being along said path at the downstream edges of at least the last ones of said coils of a set and as the strip emerges bearing the heating effect of said at least the last ones of said coils of a set and producing strip temperature signals, respectively, (b) reference means for establishing a reference temperature signal for said strip at the location of each of said radiation sensors, (c) comparator means for comparing each said temperature signal with a respective one of said reference temperature signal and producing corresponding control signals, and (d) means for applying said control signals to said control means to individually modify the electrical energy to each said sets of induction heating coils, respectively, according to the location of the corresponding radiation sensor.

6. In an electric induction furnace for use in a continuous galvanneal operation wherein a zinc-based coating applied to the surface of a running length of steel strip is converted to a zinc iron alloy coating by passing the running length of zinc coated steel strip along a generally straight vertical path through the induction furnace and heating the coated strip during upward movement through the furnace to alloy the zinc coating with iron from the steel strip, said furnace having a plurality of induction coils, including electric conductors positioned along said vertical path, each said induction coil defining a closed loop having an opening through which the running length of steel strip passes in its upward movement through the furnace, a frame supporting said plurality of induction coils, and power means supplying electric current to said plurality of induction coils for inductively heating the coated strip passing through the closed loop, the improvement comprising, a plurality of radiation emissivity transducers vertically spaced with said coils and mounted on said frame, at least the last one of said radiation emissivity transducers being oriented to detect the radiation emission of said strip issuing from the upper most one of said induction coils at a location immediately downstream thereof where the zinc-based coating is in the molten state, and producing a first electrical signal corresponding to the instantaneous temperature of said strip at that location and the others of said radiation emissivity transducers being interspersed between said induction coils, microprocessor means for:

(1) selecting one or more of said radiation emissivity transducers to produce one or more of said first electrical signal corresponding to the instantaneous temperature of said strip at selected locations, and (2) producing a second electrical signal corresponding to the desired temperature of said strip at said selected locations, and (3) comparing said first electrical signal with said second electrical signal and producing furnace temperature control signals, control means for controlling the electrical energy to said plurality of induction coils, and means for applying said furnace temperature control signals to said control means to modify the electrical energy to said plurality of induction coils.

7. The electric induction furnace defined in claim 6 wherein said plurality of induction coils are connected in sets, each set including an upper coil and a lower coil, means connecting said coils of a set in series electrical circuit, and each one of said plurality of said radiation emissivity transducer means corresponding to a coil set and being located adjacent the exit end of said uppermost coil of its corresponding coil set.

8. The electric induction furnace defined in claim 7 wherein said radiation emissivity transducers are infrared pyrometers having a predetermined range.

9. The electric induction furnace defined in claim 6 wherein said induction coils and said radiation emissivity transducer means are mounted on a movable carriage, each said plurality of induction coils having an end section which is movable to permit said plurlaity of induction coils to be opened and moved on said carriage from encirclement of said strip to an ineffective position.

10. A method producing galvanized steel strip in an electric induction galvanneal furnace having means for passing a continuous steel strip from a pot of molten zinc based coating metal in an upward direction through a substantially vertical path, through a plurality of sets of induction heating coils positioned along said vertical path, with each of said induction heating coil sets being electrically connected to a controlled source of electrical energy for raising the temperature of the strip to a temperature to cause the alloying of said molten zinc based coating metal with iron from said steel strip comprising, individually controlling the energy to each said set of induction heating coils by providing a plurality of radiation sensors for sensing the radiation emissivity of the strip as a function of the temperature of said strip, each said radiation emission sensor being positioned and oriented along said vertical path at the downstream edge of at least the last ones of said coils of a set, respectively, and as the strip emerges bearing the heating effect of said at least the last ones of said coils of a set and producing strip temperature signals, respectively, the upper-most one of said radiation sensors being oriented to sense where the zinc based metal coating is wet and in a molten state, establishing a reference temperature signal for said strip at the location of each of said radiation sensors, comparing each said temperature signal with a respective one of said reference temperature signal and producing corresponding control signals, and applying said control signals to said control means to individually modify the electric energy to each said sets of induction heating coils, respectively.

* * * * *

UNITED STATES PATENT AND TRADEMARK OFFICE

CERTIFICATE OF CORRECTION

PATENT NO. : 4,845,332

DATED : July 4, 1989

INVENTOR(S) : David G. Jancosek et al

It is certified that error appears in the above-identified patent and that said Letters Patent is hereby corrected as shown below:

Front page, line [73] after National Steel Corp., Pittsburgh, Pa., insert -- And Ajax Magnethermic Corporation, Warren, Ohio--

Column 2, line 20, delete "Schneider" and insert --Schnedler--.

Signed and Sealed this

Nineteenth Day of June, 1990

*Attest:*

HARRY F. MANBECK, JR.

*Attesting Officer*

*Commissioner of Patents and Trademarks*